United States Patent [19]

Jones

[11] Patent Number: 4,589,624

[45] Date of Patent: May 20, 1986

[54] WINDOW BUCK OR POURING FRAME

[76] Inventor: Kenneth H. Jones, 1425 N. 1000 West, Mapleton, Utah 84663

[21] Appl. No.: 612,726

[22] Filed: May 21, 1984

[51] Int. Cl.[4] ..... B28B 7/30

[52] U.S. Cl. ..... 249/177; 52/215; 249/39; 249/184

[58] Field of Search ..... 249/39, 177, 184, 186, 249/178, 195, 196; 52/215, 127.2, 217

[56] References Cited

U.S. PATENT DOCUMENTS

| | | | |
|---|---|---|---|
| 1,050,816 | 1/1913 | Deslauriers | 249/219 R |
| 1,881,971 | 10/1932 | Roedig | 249/95 |
| 2,602,983 | 7/1952 | Troiel | 249/39 |
| 2,787,820 | 4/1957 | Shields et al. | 249/39 |
| 2,831,231 | 4/1958 | Toensing | 249/219 R |
| 2,893,235 | 7/1959 | Goldberg | 249/39 |
| 2,901,810 | 9/1959 | Richards | 249/39 |
| 3,092,887 | 6/1963 | Switzer | 249/39 |
| 3,420,003 | 1/1969 | Cline | 52/217 |
| 3,439,894 | 4/1969 | Haider | 249/39 |
| 3,995,843 | 12/1976 | Kasteler | 249/39 |
| 4,138,084 | 2/1979 | Reid | 249/39 |
| 4,433,826 | 2/1984 | Schimmel | 249/166 |

FOREIGN PATENT DOCUMENTS

| | | | |
|---|---|---|---|
| 911523 | 7/1946 | France | 249/39 |
| 36796 | 2/1923 | Norway | 249/39 |

*Primary Examiner*—Jay H. Woo
*Assistant Examiner*—James Housel
*Attorney, Agent, or Firm*—Calvin E. Thorpe; Vaughn W. North; M. Wayne Western

[57] ABSTRACT

A reusable window buck or pouring frame for forming a window opening in a cast concrete wall or the like is provided. The window buck comprises an inner and outer rectangular frame in which the inner frame is adapted to be at least partially received in mating relationship within the outer rectangular frame. Releasable clamp means are provided for releasably securing the inner and outer rectangular frame structures together as a substantially interlocked unit.

16 Claims, 4 Drawing Figures

WINDOW BUCK OR POURING FRAME

BACKGROUND OF THE INVENTION

1. Field

The present invention relates to window bucks, surrounds, or pouring frames for forming a window opening in poured concrete walls.

2. State of the Art

In pouring window walls such as basement walls, window openings are commonly formed in the concrete walls as the walls are poured. It was common in the past to construct wooden window openings as a part of the wood forms for the concrete walls. After the poured concrete had set, the wood forms including the wooden window portions were removed, and usually the wooden window portions of the forms, at least, had to be discarded. The cost of the wood forms and the labor required in building the forms with integral wooden window forms were distinct disadvantages of this type of construction.

To avoid the disadvantages of constructing wooden window opening forms within the wall forms, two general methods have been proposed. The first of these methods is to provide reusable, metal, buck forms which are positioned between the spaced walls of the concrete wall forms. The buck forms are commonly made in two parts and are bevel shaped such that when the concrete, which has been poured around the buck form has set, the buck forms can be removed from the opening formed in the resulting concrete wall.

A window frame can be detachably secured to the buck frame such that the window frame is cast in and remains in the opening when the concrete sets and the removable buck is removed. For example, see U.S. Pat. Nos. 3,092,887 and 2,787,820. A more generally used method involves the use of a removable buck form which can be shaped or made of two parts such that a mounting ledge or step is formed in the concrete to which a window frame can be mounted after the concrete has set and the removable buck has been removed. For example, see U.S. Pat. Nos. 4,138,084 and 3,439,894. To provide adjustment to accommodate varying thicknesses of concrete walls, the forms have been made with contiguous sliding members or the two parts of the buck form have been adapted to be mated and insertable one within the other to accommodated various thicknesses of the desired concrete wall. For example, see U.S. Pat. Nos. 1,881,971 and 4,138,084.

The second general method which has been proposed to avoid the in-situ construction of wooden window opening forms within the wall forms, employs a metal buck frame which is positioned between the spaced walls of the concrete wall forms. Concrete is poured around the buck form, and when the concrete has set, the wall forms are removed, leaving the buck form in place to form the periphery of the window opening. For example, see U.S. Pat. No. 2,893,235. These buck forms have been found to be subject to being deformed during the pouring of concrete thereabouts as the wall is being formed unless reinforcement or support is provided for the buck frame. For example, see U.S. Pat. No. 3,995,843 which discusses the problem and discloses a particular, reusable brace to be used to at least reduce the severity of the problem.

3. Objectives

It is a principal objective of the present invention to provide a novel, improved window buck or pouring frame for forming a window opening in a cast concrete wall or the like, wherein the window buck or pouring frame comprises mating inner and outer rectangular frame members which are adapted to be releasably secured together as a substantially interlocked unit, and further wherein the window buck or pouring frame is adapted to be readily mounted between the spaced walls of concrete wall forms.

A broad, general objective of the present invention is to provide a relatively easily maneuverable window buck or pouring frame which is relatively inexpensive to manufacture, is rugged in construction, is simple to use, and can be reused practically indefinitely.

A particular objective of the present invention is to provide novel, unique, rugged clamp means for releasably securing the inner and outer rectangular frame structures of a two-part window buck or pouring frame together as a substantially interlocked unit, with the clamp means being quickly and easily engaged and disengaged, whereby the window buck or pouring frame can be quickly incorporated in the wooden forms for the concrete wall as well as quickly removed or stripped from the window opening after the concrete wall has been poured and the concrete has set.

A further object of the present invention is to provide adjustable clamp means which allows the inner and outer rectangular frame structures of a two-part window buck or pouring frame to be mated and inserted one within the other so as to provide for adjusting the window buck or pouring frame to fit within varying thicknesses of concrete wall forms.

An additional object of the present invention is to provide novel means for connecting the relatively inexpensive clamp means to the inner and outer rectangular frame structures, whereby the clamp means can quickly be removed from the frame structure for cleaning and replacement purposes in case the clamp means become fouled or damaged.

SUMMARY OF THE INVENTION

The above objectives are achieved in accordance with the invention by providing a novel, unique window buck or pouring frame for forming a window opening in a cast concrete wall or the like. The window buck or pouring frame of the invention has a pair of rectangular frame structures. The outer rectangular frame structure is constructed and adapted to receive the mating inner rectangular frame structure. The outer rectangular frame structure is formed from four, elongate, substantially flat, board-like base members which are attached together in end-to-end arrangement so as to define a rectangular enclosure which is generally open at its opposite, broad, first and second ends. The inner rectangular frame structure is formed from four, elongate, substantially flat, board-like side walls which are attached together in end-to-end arrangement so as to define a substantially rectangular enclosure which is generally open at its opposite, broad, first and second ends.

The first open end of the inner rectangular frame structure is adapted to be inserted through the corresponding first open end of the outer rectangular frame structure such that at least a portion of the inner rectangular frame structure is received in mating relationship within the outer rectangular frame structure.

Novel releasable clamp means are provided for releasably securing the inner and outer rectangular frame structures together as a substantially interlocked unit. The clamp means comprises at least one elongate, rigid clamp member provided for at least one of the four base members of the outer rectangular frame structure. Each of the clamp members is pivotally connected at one of its ends to a mutually corresponding base member at a location on the base member which is adjacent to or at the second open end of the outer rectangular frame structure, and each clamp member is adapted to extend from its attachment to the outer rectangular frame structure to at least the first open end of the inner rectangular frame structure when the inner rectangular frame structure is mated with the outer frame structure. Means are then provided for releasably securing the extending ends of the clamp members to the inner rectangular frame structure so as to hold the inner rectangular frame structure and the outer rectangular frame structure together as a substantially interlocked unit.

The base members of the outer rectangular frame structure and the side walls of the inner rectangular structure are beveled to permit extraction of the outer and inner rectangular frame structures from the set concrete wall. Preferably, each of the perimeters of the outer and inner rectangular frame structures have inwardly extending flanges which provide reinforcing strength to the respective frame structures. In addition, the outermost flanges may have a plurality of holes or apertures formed therein which are adapted to be used in attaching the window buck or pouring frame to the wooden form for the concrete wall. Corner braces are preferably provided at each of the corners of the inner rectangular frame structure to provide additional strength to the window buck or pouring frame when concrete is poured around the window buck or pouring frame.

In preparation for pouring a concrete wall with a window opening, the inner rectangular frame structure is inserted into mating relationship with the outer frame structure, and the releasable clamp means are engaged so as to interlock the two rectangular frame structures together as a unit. The assembled unit is nailed to the wooden form for the concrete wall in the desired position of the opening. The other concrete wall form is then placed snugly against the exposed end of the interlocked unit and concrete can then be poured between the wall forms and around the interlocked buck or pouring frame.

When the concrete is set, the wall forms may be removed. The window buck or pouring frame, which remains in position around the window opening in the concrete wall, is removed by first disengaging the clamp members and then extracting the two frame structures from opposite sides of the window opening in the concrete wall. The rectangular frame structures can then be cleaned and reused.

Additional objects, features and advantages of the present invention will become apparent from a consideration of the following detailed description presented in connection with the accompanying drawings.

BRIEF DESCRIPTION OF THE DRAWINGS

A window buck or pouring frame which illustrates preferred embodiments in accordance with the present invention and which incorporates the best mode presently contemplated of carrying out the invention, is illustrated in the drawings, in which.

DETAILED DESCRIPTION OF THE PREFERRED EMBODIMENTS

Figure 1:
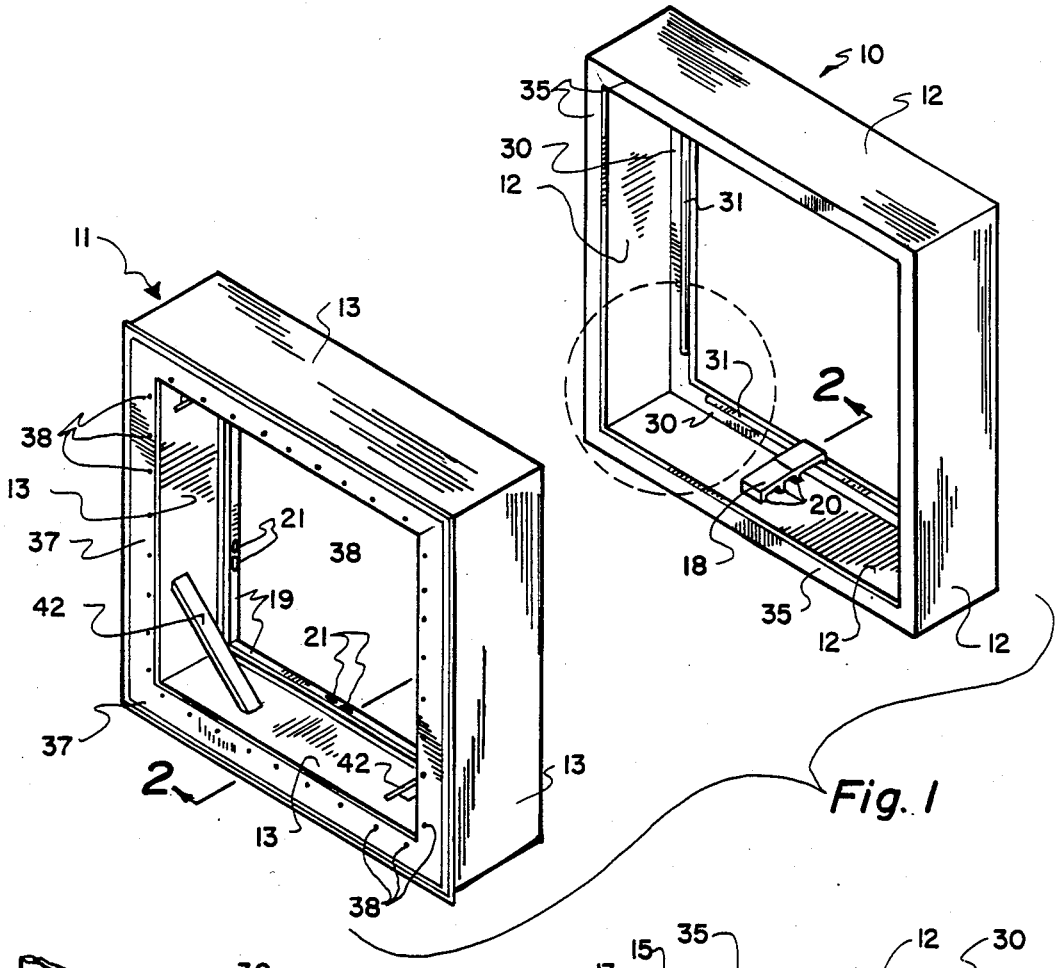
FIG. 1 is an exploded pictorial of a reusable window buck or pouring frame in accordance with the present invention.

A preferred general embodiment of the window buck or pouring frame of the present invention is shown in the drawings. As illustrated, the window buck or pouring frame comprises an outer rectangular frame structure, shown generally by the numeral 10 in FIG. 1 of the drawings, and an inner rectangular frame structure, shown generally by the numeral 11 in FIG. 1 of the drawings.

The outer frame structure 10 comprises four elongate, rigid, substantially flat, board-like base members 12 which are attached together in substantially end-to-end arrangement to form the periphery of a framework circumscribing and defining a rectangular enclosure which is generally open at its opposite, broad, first and second ends. The inner rectangular frame structure 11 is formed from four elongate substantially flat, board-like side walls 13 which are attached together in end-to-end arrangement so as to define a substantially rectangular enclosure which is generally open at its opposite, broad, first and second ends. The first open end of the inner rectangular frame structure 11 is adapted to be inserted through the corresponding first open end of the outer rectangular frame structure 10 such that at least a portion of the inner rectangular frame structure 11 is received in mating relationship within the outer rectangular frame structure 10.

Figure 2:
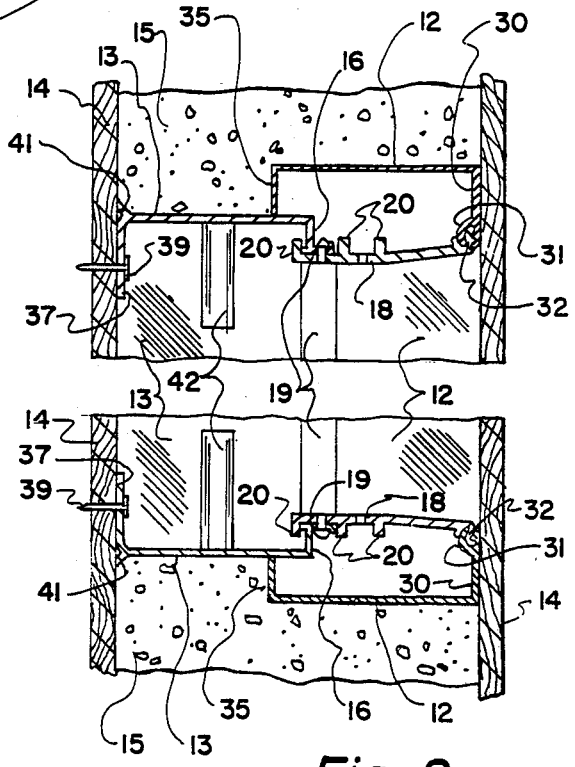
FIG. 2 is a vertical cross section of a window buck or pouring frame similar to the one of FIG. 1, with the view taken along line 2—2 of FIG. 1.

The inner and outer frame structures are shown in cross section in their mating relationship in FIG. 2, wherein the window buck or pouring frame is shown in position between opposite sides 14 of a wall form for a concrete wall. Concrete 15 is shown poured in place around the window buck or pouring frame. As shown, the side walls 13 of the inner frame structure are received in generally telescopic-like, mating relationship within the base members 12 of the outer frame structure. As will be described more fully hereinafter, releasable clamp means are provided for releasably securing the inner and outer frame structures together as a substantially interlocked unit. The interlocked unit has an effective width of the concrete wall which is to be poured. The interlocked unit, i.e., the buck frame or pouring frame of the present invention, is adapted to be readily and easily positioned between the sides 14 of a wall form, and when concrete 15 is poured in the form around and about the buck frame or pouring frame, a window opening is formed in the poured concrete wall.

At least one, elongate, rigid clamp member 18 is provided for at least one of the four base members 12 of the outer rectangular frame structure, with each rigid clamp member 18 being pivotally connected at one of its ends to a mutually corresponding base member 12 at a location on the base member 12 which is adjacent to or at the second open end of the outer rectangular frame structure. Each rigid clamp member 18 is pivotally attached at one of its ends directly to the outer rectangular frame structure through a rigid, pivoting connection between the pivotal end of the clamp member 18 and the outer rectangular frame structure. Thus, the pivotal connection of the clamp member 18 to the outer rectangular frame structure is seen to be distinguished from nonrigid connections made by flexible connectors such as chains, cables, etc. In the present invention, the pivotal end of each clamp member 18 is attached firmly to the outer rectangular frame structure, and the clamp member 18 is adapted to pivot about a pivot axis at the pivotal end of the clamp member 18. To hold the inner and outer rectangular frame structures together as a rigid unit, at least one rigid clamp member 18 is preferably provided for each of the four base members 12 of the outer rectangular frame structure.

Means are provided for releasably securing the extending ends of the clamp members 18 to the inner rectangular frame structure. As illustrated, in one preferred embodiment of the invention, a flange 16 is provided around the periphery of the first open end of the inner rectangular frame structure. The flange 16 extends inwardly from the perimeter of the side walls 13 of the inner rectangular frame structure in the general direction of the enclosed area formed by the inner rectangular frame structure, and means are provided for releasably securing the extending ends of the clamp members 18 to the flange 16 at the periphery of the first open end of the inner rectangular frame structure.

In the preferred embodiment of the invention as illustrated, a lip or ledge 19 is provided around the flange 16. The lip or ledge 19 is integrally attached to the otherwise free extending edge of the flange 16, such that the lip or ledge 19 projects from at least one side of the flange 16 in a plane which is substantially perpendicular to the flange 16. Means are then provided for releasably securing the extending ends of the clamp members 18 to the lip or ledge 19 at the periphery of the first open end of the inner rectangular frame structure. In a preferred embodiment of the invention, the means for releasably securing the ends of the clamp members 18 to the lip or ledge 19 comprises at least two, spaced projections 20 which extend downwardly from the free end portion of each of the clamp members 18. The projections 20 on each clamp member 18 are spaced from each other such that when the respective clamp member 18 is secured to the lip or ledge 19 at the periphery of the first open end of the inner rectangular frame structure, the lip or ledge 19 is received within the space between adjacent projections 20, with the respective projections 20 abutting the opposite side edges of the lip or ledge 19.

In a particularly preferred form of the invention, at least three equally spaced projections 20 extend downwardly from the end portion of each of the clamp members 18. The three equally spaced projections permit the inner and outer, rectangular frame structures to be maintained at two, adjustable positions with respect to each other. As is readily recognized, when the lip or flange 19 of the inner rectangular frame structure is received within mutually respective spaces between the projections 20 on the clamp members 18, the inner and outer frame structures are held in fixed position with respect to each other. When the lip or flange 19 of the inner frame structure is received in the outermost spaces between projections 20, the opposite open ends of the inner and outer frame structures are maintained at a maximum distance. When the lip or flange 19 of the inner frame structure is received in the innermost spaces between projections 20, the opposite open ends of the inner and outer frame structures is maintained at a minimum distance. Advantageously, the projections 20 are positioned such that the outer spaces correspond to one generally used width of cement walls, and the inner spaces correspond to another but smaller used width of cement walls. For instance, it is common in construction to use both nominal 9 inch and nominal 8 inch width concrete foundation walls. The projections 20 on the clamp members 18 are thus advantageously spaced such that the outer spaces correspond to the nominal 9 inch spacing between the opposite open ends of the inner and outer frame structures, and the inner spaces correspond to the nominal 8 inch spacing. Thus, the buck frame or pouring frame can be used in making either nominal 8 inch or nominal 9 inch walls. The end portion of the clamp members 18 could be provided with more than three equally spaced projections 20 which would provide additional adjustment in the widths of the window buck or pouring frame. However, it has been found that using three projections 20 on each clamp member 18 to provide for use of the window buck or pouring frame in two commonly used widths is completely satisfactory.

Figure 3:
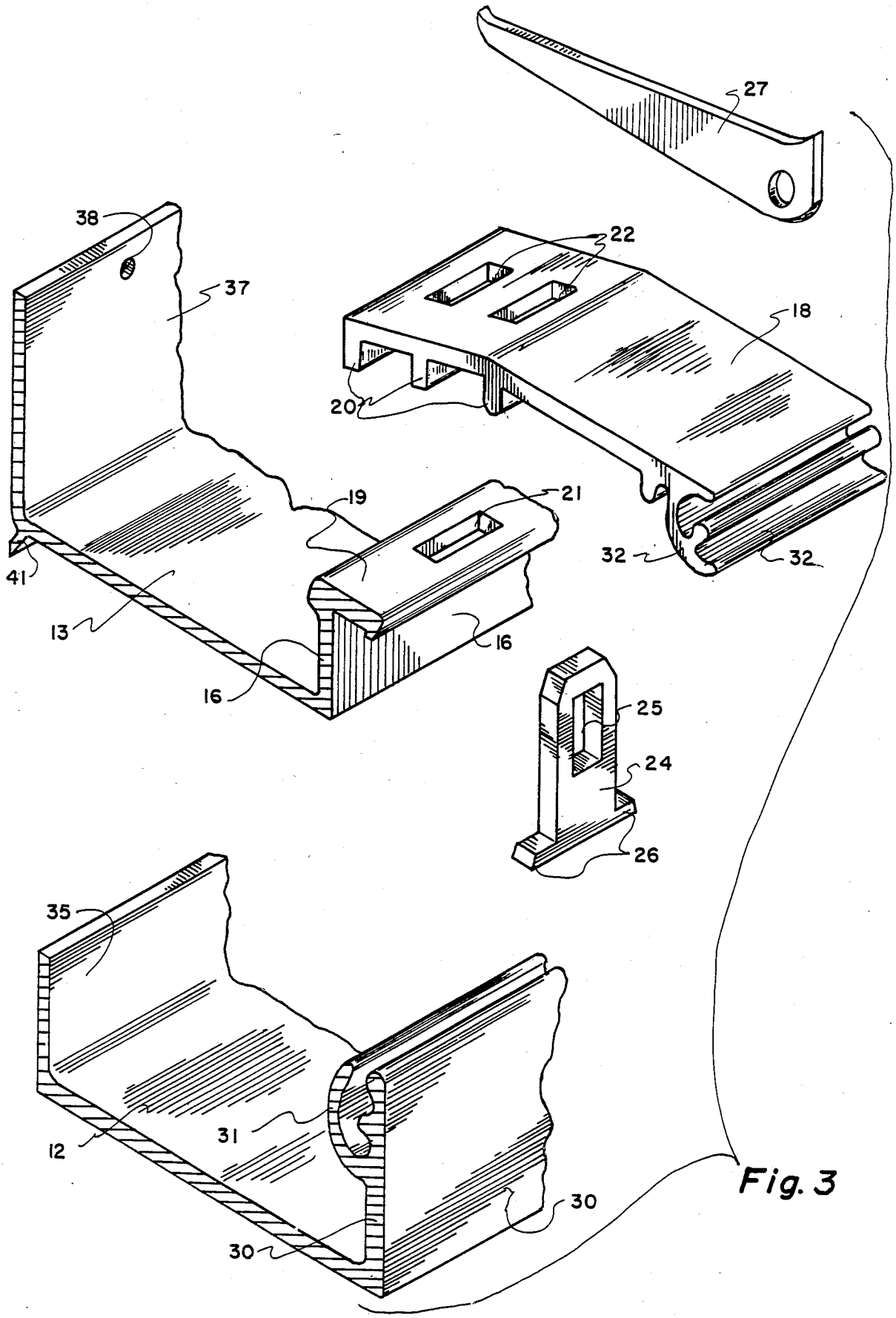
FIG. 3 is an exploded pictorial in partial cross section through one of the peripheral sides of a window buck or pouring frame in accordance with the present invention showing a preferred key and wedge mechanism for releasably securing the extending ends of the clamp members to the inner rectangular frame structure.

In the preferred embodiment of the invention, as illustrated, means are provided for securely clamping or holding the end portions of the clamp members 18 in engagement with the lip or ledge 19 at the periphery of the first open end of the inner rectangular frame structure. As shown in the drawings, the means for releasably securing the extending ends of the clamp members 18 to the lip or ledge 19 comprises a plurality of rectangular openings 21, in the lip or ledge 19, with at least one rectangular opening being provided in the lip or ledge 19 intermediate mutually respective corners of the inner rectangular frame structure. At least one rectangular opening 22 (FIG. 3) is provided in each of the clamp members 18 such that the openings 22 in the clamp members 18 are adapted to be brought into alignment with mutually respective openings in the lip or ledge 19 when the clamp members 18 are brought into position adjacent to the lip or ledge 19. The openings 22 in the clamp members 18 are located between the projections 20. Thus, as illustrated in FIG. 3, when the clamp member 18 has three equally spaced projections 20, there will be two openings 22 which are located equally spaced between mutually adjacent pairs of projections 20. In those situations where each clamp member 18 has only two projections 20, there will in turn be only one opening 22. Likewise, if the clamp member 18 were provided with more than three projections 20, there would in turn be a number of openings 22 provided with the number of openings 22 being one less than the number of projections 20 on the clamp member 18.

As shown in FIG. 3, elongate, flat key members 24 are provided. The key members 24 are adapted to slide through the respective openings 21 in the lip or ledge 19 and the mutually respective, aligned openings 22 in the clamp members 18. A separate key member 24 is provided for each clamp member 18, with each of the key members 24 further having an elongate opening 25 therein. Each key member 24 also has a pair of ears 26 which extend outwardly from one end of the key member 24, such that when the respective key members 24 are positioned through the mutually respective, aligned openings 21 and 22 in the lip or ledge 19 and the clamp members 18, the ears 26 on the key members 24 engage and abut the side of the lip or ledge 19 which faces away from the respective clamp members 18.

An elongate wedge member 27 is provided for each key member 24, with the wedge member 27 being adapted to fit through the opening 25 in its mutually respective key member 24. When the respective key members 24 are positoned through the mutually respective, aligned openings 21 and 22 in the lip or ledge 19 and the clamp members 18, respectively, and when the wedge member 27 is then pushed into wedged engagement in the opening 25 in the key member 24, the clamp member 18 and the lip or ledge 19 are held in secure engagement by the wedging action between the key members 24 and the respective wedge members 27. The clamp members 18 can, of course, be readily disengaged from the lip or ledge 19 by simply withdrawing the respective wedge members 27 and removing the key members 24, whereby the clamp members 18 can then be lifted from the lip or ledge 19.

In the preferred embodiment of the window buck or pouring frame as illustrated, the pivotal ends of the clamp members 18 are pivotally connected to the respective base members 12 of the outer frame structure through a flange 30 which is provided around the periphery of the second open end of the outer rectangular frame structure. Pivotal connecting means are associated with the clamp members 18 and the flange 30 for pivotally connecting the clamp members 18 to the flange 30. The flange 30 extends inwardly from the perimeter of the base members 12 of the outer rectangular frame in the general direction of the enclosed area formed by the outer rectangular frame.

The means for pivotally connecting the clamp members 18 to the flange 30 preferably comprises an elongate curved appendage 31 which projects from the free end portion of the flange 30. The curved appendage 31 together with the free end of the flange 30 forms an elongate channel which extends along the free end of the flange between respective corners of the outer rectangular frame structure. The respective ends of the clamp members 18 which are to be pivotally connected to the flange 30 are provided with a projection 32 which is shaped so as to be received within the elongate channel extending along the free end of the flange 30. The projection 32 is received in the channel for sliding movement back and forth along the length of the elongate channel as well as for limited pivotal movement about the longitudinal axis of the elongate channel. Thus, the respective clamp members 18 are adapted to slide back and forth along the flange 30 between mutually respective corners of the outer rectangular frame structure, and the clamp members 18 are also adapted to pivot about a longitudinal axis parallel with and substantially along the free end of the flange 30 between mutually respective corners of the outer rectangular frame structure.

Figure 4:
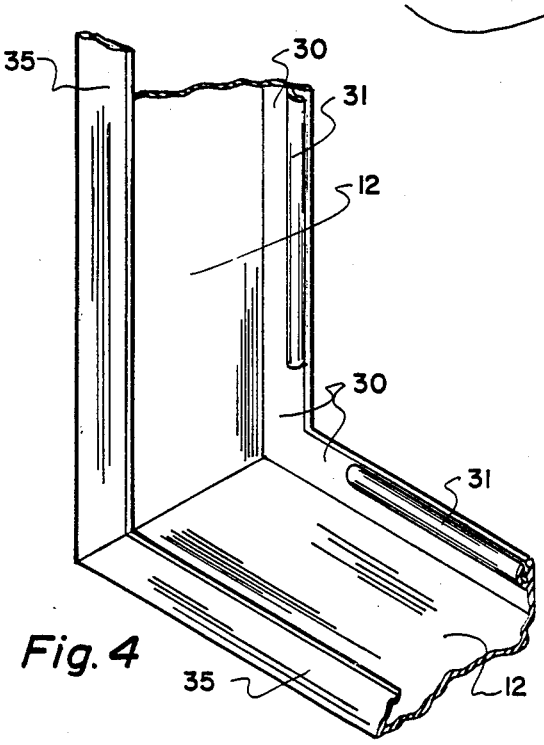
FIG. 4 is an enlarged, broken away pictorial of a corner section of the outer cross sectional view as taken within the circular area 4 of FIG. 1.

To accommodate positioning of the projections 32 of mutually respective clamp members 18 in the elongate channel formed by the curved appendage 31 and the free end of the flange 30, the curved appendage 31 is preferably terminated short of the corners of the outer rectangular frame structure as is shown in FIG. 4 of the drawings. The distance between the termination of the curved appendages 31 and the respective corners of the outer rectangular frame structure is at least as great as the width of the respective clamp members 18. Thus, the clamp members can be engaged and disengaged from the elongate channel formed by the curved appendage 31 and the free end of the flange 30 at or adjacent the corners of the outer rectangular frame structure.

In the preferred embodiment of the window buck or pouring frame as illustrated, an inner flange 35 is provided around the periphery of the first open end of the outer rectangular frame structure. The inner flange 35 extends inwardly from the perimeter of the base members 12 of the outer rectangular frame in the general direction of the enclosed area formed by the outer rectangular frame. The first open end of the inner rectangular frame structure is adapted to be inserted within the outer rectangular frame structure such that the side walls 14 of the inner rectangular frame structure make telescopic sliding engagement with the extending perimeter of the inner flange 35, as is best shown in FIG. 2. The flange 35 preferably has the width, i.e., the distance that it extends from the base member 12, which is the same as a conventional piece of wood construction which can be used to finish the window opening after the window buck or pouring frame has been removed from the set concrete wall. Generally, a wooden member having a thickness of about 1.5 inches will be used in finishing the window opening. The width of the flange 35 would preferably be between about 1 and 1.5 inches under such circumstances. After the poured concrete has set and the window buck or pouring frame has been removed from the opening in the concrete wall, the wooden members which are to finish the opening can be affixed to the concrete so as to abut the shoulder formed in the concrete by the flange 35 of the outer rectangular frame structure.

The inner rectangular frame structure is preferably provided with a flange 37 around the periphery of the second open end of the inner rectangular frame structure. The flange 37 extends inwardly from the perimeter of the side walls 13 of the inner rectangular frame structure in the general direction of the enclosed area formed by the inner rectangular frame. Preferably, there are a plurality of spaced apertures 38 provided in the flange 37. The apertures 38 are adapted for accepting nails 39 as shown in FIG. 2 to attach the window buck or pouring frame to the side boards 14 of the wall forms into which concrete is poured to produce a concrete wall. In constructing the forms for the concrete wall, one of the sides 14 of the forms is erected. The inner rectangular frame structure of the assembled window buck or pouring frame of the present invention is then positioned at the desired placement on the wall form, with the flange 37 lying flatwise against the wooden side 14 of the wall form. Nails are driven through at least some of the apertures 38 in the flange 37 so as to affix the inner rectangular frame structure in its desired placement. The remaining wall form is then positioned adjacent to the extending open end of the window buck or pouring frame, and the form is ready to have concrete poured therein.

When the concrete has set, the wooden walls 14 of the form are removed. The clamp members 18 of the window buck or pouring frame are disengaged, and the inner rectangular frame structure is removed from one side of the resulting opening in the concrete wall, with the outer rectangular frame structure being removed from the other side of the opening in the concrete wall. As is well known in the art, the base members 12 of the outer frame structure and the side walls 13 of the inner frame structure are tapered or beveled to permit easy extraction of the frame structures from the set concrete.

An oblique lip 41 can be provided around the periphery of the second open end of the inner rectangular frame structure, with the lip 41 extending outwardly from the side walls 13 of the inner rectangular frame in a general direction outwardly of the enclosed area formed by the inner rectangular frame structure. The free end of the oblique lip 41 terminates in the plane of the flange 37 around the periphery of the second open end of the inner rectangular frame structure. As can be seen from FIG. 2, the oblique lip 41 advantageously forms a beveled edge to the edge perimeter of the opening in the concrete wall. A corresponding lip could be provided on the outer rectangular frame structure, to produce a corresponding beveled edge to the other edge perimeter of the opening in the concrete wall. However, the opening is generally finished with a wooden frame as mentioned briefly above, and the wooden frame generally extends to the inside edge of the opening and forms a nailer to which finish framing can be affixed. Thus, there is generally no need of a corresponding lip on the outer rectangular frame structure inasmuch as there is no need of a beveled edge on the inside edges of the window on the inside edges of the window opening.

To strengthen the window buck or pouring frame, corner braces can be provided at each of the corners of the inner rectangular frame structure. If so desired, angle brances 42 can also be provided at each corner of the outer rectangular frame structure; however, such angle braces on the outer rectangular structure are not required inasmuch as the braces on the inner rectangular structure provide sufficient strength for the window buck.

The window buck or pouring frame, including the inner and outer frame structures, is preferably made of metal and in particular aluminum. However, the window buck or pouring frame could also be made of other rigid, strong materials such as reinforced polymeric materials commonly referred to as fiberglass.

Although preferred embodiments of the window buck or pouring frame have been illustrated and described, it is to be understood that the present disclosure is made by way of example and that various other embodiments are possible without departing from the subject matter coming within the scope of the following claims, which subject matter is regarded as the invention.

I claim:

1. A reusable window buck or pouring frame for forming a window opening in a cast concrete wall or the like, said window buck or pouring frame comprising an outer rectangular frame structure formed from four, elongate, substantially flat, board-like base members which are attached together in end-to-end arrangement so as to define a rectangular enclosure which is generally open at its opposite, broad, first and second ends;

an inner rectangular frame structure formed from four, elongate, substantially flat, board-like side walls which are attached together in end-to end arrangement so as to define a substantially rectangular enclosure which is generally open at its opposite, broad, first and second ends, with the first open end of the inner rectangular frame having a dimension which allows said inner rectangular frame to be inserted through the corresponding first open end of the outer rectangular frame structure such that at least a portion of the inner rectangular frame structure is received in mating relationship within the outer rectangular frame structure;

releasable clamp means are provided for releasably securing the inner and outer rectangular frame structures together as a substantially interlocked unit, said clamp means comprising at least one elongate, rigid clamp member provided for at least one of the four base members of the outer rectangular frame structure, with each clamp member being pivotally connected at one of its ends to a mutually corresponding base member at a location on the base member which is adjacent to or at the second open end of the outer rectangular frame structure, whereby each clamp member extends at least to the inner rectangular frame structure when the inner rectangular frame structure is mated with the outer rectangular frame structure; and means for releasably securing the extending ends of the clamp members to the inner rectangular frame structure.

2. A reusable window buck or pouring frame in accordance with claim 1, wherein a flange is provided around the periphery of the first open end of the inner rectangular frame structure, with the flange extending inwardly from the perimeter of the side walls of the inner rectangular frame structure in the general direction of the enclosed area formed by the inner rectangular frame structure, and means are provided for releasably securing the extending ends of the clamp members to the flange at the periphery of the first open end of the inner rectangular frame structure.

3. A reusable window buck or pouring frame in accordance with claim 2, wherein a lip or ledge is provided around the flange at the first open end of the inner rectangular frame structure, said lip or ledge being integrally attached to the otherwise free extending edge of the flange, with the lip or ledge projecting from at least one side of the flange in a plane which is substantially perpendicular to the flange; and means are provided for releasably securing the extending ends of the clamp members to the lip or ledge at the periphery of the first open end of the inner rectangular frame structure.

4. A reusable window buck or pouring frame in accordance with claim 3, wherein at least two, spaced projections extend downwardly from the end portion of each of the clamp members, said projections being spaced such that when the respective clamp member is secured to the lip or ledge at the periphery of the first open end of the inner rectangular frame structure, the lip or ledge is received within the space between adjacent projections with the respective projections abutting the opposite side edges of the lip or ledge.

5. A reusable window buck or pouring frame in accordance with claim 4, wherein at least three equally spaced projections extend downwardly from the end portion of each of the clamp members.

6. A reusable window buck or pouring frame in accordance with claim 3, wherein the means for releasably securing the extending ends of the clamp members to the lip or ledge at the periphery of the first open end of the inner rectangular frame structure comprises a plurality of rectangular openings in the lip or ledge with at least one rectangular opening being provided in the lip or ledge intermediate mutually respective corners of the inner rectangular frame structure;

at least one rectangular opening is provided in each of the clamp members such that the openings in the clamp members are adapted to be positioned in alignment with mutually respective openings in the lip or ledge when the clamp members are brought into position adjacent to the lip or ledge;

elongate, flat key members are provided, said key members being adapted to slide through the openings in the lip or ledge and the openings in the clamp members, with a key member being provided for each clamp member, each of said key members further having an elongate opening and also having a pair of ears which extend outwardly from one end of the key member such that when the key members are positioned through the aligned openings in the lip or ledge and the respective clamp members, the ears on the key members engage the side of the lip or ledge which faces away from the respective clamp members; and an elongate wedge member is provided for each key member, with the wedge member being adapted to fit through the opening in its mutually respective key member such that when the key member is positioned through the aligned openings in the lip or ledge and the respective clamp member, and the wedge member is then pushed into wedged engagement in the opening in the key member, the clamp member and the lip or ledge are held in secure engagement by the wedging action between the key member and the wedge member.

7. A reusable window buck or pouring frame in accordance with claim 6, wherein at least two spaced projections extend downwardly from the ends of each of the clamp members, said projections being spaced such that when the respective clamp member is secured to the lip or ledge at the periphery of the first open end of the inner rectangular frame structure, the lip or flange is received within the space between adjacent projections with the respective projections abutting the opposite side edges of the lip or flange.

8. A reusable window buck or pouring frame in accordance with claim 7, wherein at least three equally spaced projections extend downwardly from the ends of each of the clamp members.

9. A reusable window buck or pouring frame in accordance with claim 1, wherein an outer flange is provided around the periphery of the second open end of the outer rectangular frame structure, with the outer flange extending inwardly from the perimeter of the base members of the outer rectangular frame structure in the general direction of the enclosed area formed by the outer rectangular frame structure, and the respective clamp members are pivotally connected at their mutually respective one ends to the outer flange at the periphery of the second open end of the outer rectangular frame structure.

10. A reusable window buck or pouring frame in accordance with claim 9, wherein the respective clamp members are slidable back and forth along the outer flange between mutually respective corners of the outer rectangular frame structure.

11. A reusable window buck or pouring frame in accordance with claim 10, wherein the free end portion of the outer flange between respective corners of the outer rectangular frame structure is provided with an elongate curved appendage which together with the free end of the outer flange, forms an elongate channel extending along the free end of the outer flange, and the respective one ends of the clamp members are provided with a projection which is shaped so as to be received within the elongate channel extending along the free end of the outer flange for sliding movement back and forth along the length of the elongate channel as well as for limited pivotal movement about the longitudinal axis of the elongate channel.

12. A reusable window buck or pouring frame in accordance with claim 11, wherein the curved appendage terminates short of the corners of the outer rectangular frame structure, whereby the projections on the one ends of the respective clamp members can be engaged and disengaged from the elongate channel formed by the curved appendage.

13. A reusable window buck or pouring frame in accordance with claim 1, wherein an inner flange is provided around the periphery of the first open end of the outer rectangular frame structure, with the inner flange extending inwardly from the perimeter of the base members of the outer rectangular frame structure in the general direction of the enclosed area formed by the outer rectangular frame structure, wherein the first open end of the inner rectangular frame structure is inserted within the outer rectangular frame structure with the side walls of the inner rectangular frame structure making telescopic sliding engagement with the extending perimeter of the inner flange.

14. A reusable window buck or pouring frame in accordance with claim 1, wherein the inner rectangular frame structure is provided with a second flange around the periphery of the second open end of the inner rectangular frame structure, with the second flange extending inwardly from the perimeter of the side walls of the inner rectangular frame structure in the general direction of the enclosed area formed by the inner rectangular frame structure.

15. A reusable window buck or pouring frame in accordance with claim 14, wherein spaced apertures are provided in the second flange wherein the apertures are adapted for accepting nails to attach the window buck or pouring frame to forms into which concrete is poured to produce a concrete wall.

16. A reusable window buck or pouring frame in accordance with claim 14, wherein an oblique lip is provided around the periphery of the second open end of the inner rectangular frame structure, with the oblique lip extending outwardly from the side walls of the inner rectangular frame structure in a general direction outwardly of the enclosed area formed by the inner rectangular frame structure, whereby the free end of the oblique lip terminates in the plane of the second flange around the periphery of the second open end of the inner rectangular frame structure.

* * * * *